US005347833A

United States Patent [19]

Branscum

[11] Patent Number: 5,347,833

[45] Date of Patent: Sep. 20, 1994

[54] SECURE LAUNDRY AND DRY CLEANING TRANSFER STATION

[76] Inventor: Jerry D. Branscum, 12691 W. 82 Terrace, Lenexa, Kans. 66215

[21] Appl. No.: 152,130

[22] Filed: Nov. 16, 1993

[51] Int. Cl.[5] ..... E05B 69/00

[52] U.S. Cl. ..... 70/59; 70/62; 70/63; 70/68; 211/4; 206/286; 232/1 B

[58] Field of Search ..... 70/51, 58, 59, 60, 62, 70/63, 64, 67, 69, 68; 211/4, 7, 8; 206/286, 288, 298; 190/101, 903; 232/1 B

[56] References Cited

U.S. PATENT DOCUMENTS

| | | | |
|---|---|---|---|
| 1,034,050 | 7/1912 | Williams | 211/4 |
| 1,222,963 | 4/1917 | Matchette . | |
| 1,832,715 | 11/1931 | London | 190/903 |
| 2,385,053 | 9/1945 | Bohn | 206/286 |
| 2,578,148 | 12/1951 | Peters . | |
| 2,584,046 | 1/1952 | Peters | 211/8 |
| 2,616,133 | 11/1952 | Peters . | |
| 2,631,338 | 3/1953 | Peters et al. . | |
| 2,635,304 | 4/1953 | Peters . | |
| 2,642,629 | 6/1953 | Peters | 211/4 |
| 3,613,843 | 10/1971 | Davis | 190/903 |
| 3,958,675 | 5/1976 | Rosenblum | 109/903 |
| 4,300,690 | 11/1981 | Thomas | 70/59 |
| 5,154,072 | 10/1992 | Leyden . | |
| 5,160,048 | 11/1992 | Leyden et al. . | |

*Primary Examiner*—Flemming Saether
*Attorney, Agent, or Firm*—Litman, McMahon & Brown

[57] ABSTRACT

A transfer station is provided to allow a secure transfer of goods between a service person such as a cleaner and an owner of the goods at the owner's residence when the owner is not at home. The station includes a bag forming an enclosure for the goods and having a handle. The station also includes a capture box with a receiver for the handle and a closure that prevents removal of the handle from the receiver when closed and locked. The box has a relatively low profile and does not capture part or all of the bag to provide security for the bag. A mechanism is also provided to close and secure the bag.

9 Claims, 2 Drawing Sheets

SECURE LAUNDRY AND DRY CLEANING TRANSFER STATION

BACKGROUND OF THE INVENTION

The present invention is directed to an apparatus that provides a secure transfer station for home transfer between a customer and a laundry or dry cleaner when the owner of the cleaning cannot be present at the time when the cleaning must be transferred to a delivery agent who picks up the laundry or dry cleaning for a cleaners. The transfer station provides security against theft and vandalism, while having a relatively low profile when not in use.

During much of this century home delivery and pick up of various products was quite common. Items such as milk, bread, ice and laundry were either picked up or delivered to the home by the company providing the service which was very convenient for the homeowner. Unfortunately, the home owner cannot always be home at the time the delivery is to be made and, therefore, the items being delivered or picked up often must be left where the delivery person can have access to them. As more families have dual wage earners, finding someone at home during the day has become even more difficult.

There have been times historically when items left on the front porch or other places outside the house were relatively secure. At times doors were even left unlocked to allow delivery persons to bring items directly into the house. However, times have changed substantially and today items are much more prone to vandalism or theft, if they are left in the open. Consequently, many companies have stopped home service because of problems associated with vandalism or theft of their products and because of declining revenue in comparison to cost.

Recent studies and test marketing has shown that laundry and dry cleaning can still be picked up and delivered to the home at a reasonable profit to the cleaning company, provided that adequate security can be provided for the goods and that the routes are run on time and efficiently. In order to be efficient a delivery person cannot spend too great a period at any particular house and cannot come back at a later time, if an owner is not at home. Therefore, for a service of this type to be profitable, there must be an effective and secure way of transferring the clothing between the owner and the delivery person that is both quick and does not require the owner to be at home.

Prior art in this field has provided a number of devices for transferring clothing, including the devices that were invented by Peters and disclosed in his U.S. Pat. Nos. 2,631,338 and 2,635,304. Unfortunately, the Peters devices did not function well. The main reason for their failure was that they were cumbersome and unattractive. The homeowner typically did not want to bother with cumbersome devices and did not want unsightly structures placed on their house. Consequently, it is also desirable that the apparatus, when not transferring clothing, maintain a relatively low profile and be adaptable to being placed in a variety of places which would not detract from the appearance of the house.

Some of the Peters devices required a large structure which at least partially captured the clothing in a lock box. This presented a large profile which was undesirable and did not prevent a thief or vandal from reaching into the clothing and pulling out something such as pants.

SUMMARY OF THE INVENTION

The present invention discloses a transfer apparatus or station effectively utilizing a bag to hold goods to be transferred with a relatively small capture box that secures the bag against unauthorized removal. The box has a relatively low profile that when not in use, does not substantially detract, from the appearance of a residence or other structure upon which the box is mounted.

The bag includes an enclosure that generally completely surrounds the goods to be transferred. The goods are placed in the bag through an opening that is closed by closure means, preferably a zipper. The zipper has a ring on the closing head through which a lanyard is secured. A tail of the lanyard is enlarged. The bag also includes an interior cross plate or stiffener with a depending loop for receiving hangers or the like.

The bag also has a handle that is partially generally rectangular with two upright side elements integrally joined at the top by an elongate generally rigid crossmember. The bottom ends of the side elements are secured to the crossplate in such a manner so as not to be removable when the bag is closed. The handle crossmember also includes a hook for hanging that is formed by bending of the material of construction.

The capture box is a generally rectangular structure having a hinged lid forming an enclosure when in a closed position except for first and second slots in the sides of the box and a third slot for reviewing and capturing the enlarged tail of the lanyard. The first and second slots open to the front when the lid is in an open position thereof and are positioned to form a receiver for holding the handle crossmember with opposite ends thereof extending out of opposite sides of the box. When the lid is closed and the crossmember is in the receiver, the crossmember is captured and cannot be removed.

The box includes a key operated lock for locking the lid in the closed position thereof. The box has mounting means, preferably including screws, to secure the box to a wall such that the box cannot be removed when the lid is in the closed position. The box further includes a clip or the like to hold money or the equivalent thereof, including bills or checks in a secure manner such that the money cannot be removed by unauthorized persons.

OBJECTS AND ADVANTAGES OF THE INVENTION

Therefore, the objects of the present invention are: to provide an apparatus for allowing the secure transfer of clothing between the owner of the clothing and a cleaner without the owner having to be present; to provide such an apparatus which prevents easy access to the clothing to others, so as to reduce the likelihood of vandalism and/or theft; to provide such an apparatus which can be only opened by the owner of the clothing and by a representative of the cleaner; to provide such an apparatus having a relatively small profile and being adapted to be located in various out of the way locations; to provide such an apparatus which also allows the transfer of funds for paying for the cleaning; and to provide such an apparatus which is relatively easy to use, simple to manufacture, inexpensive to produce and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
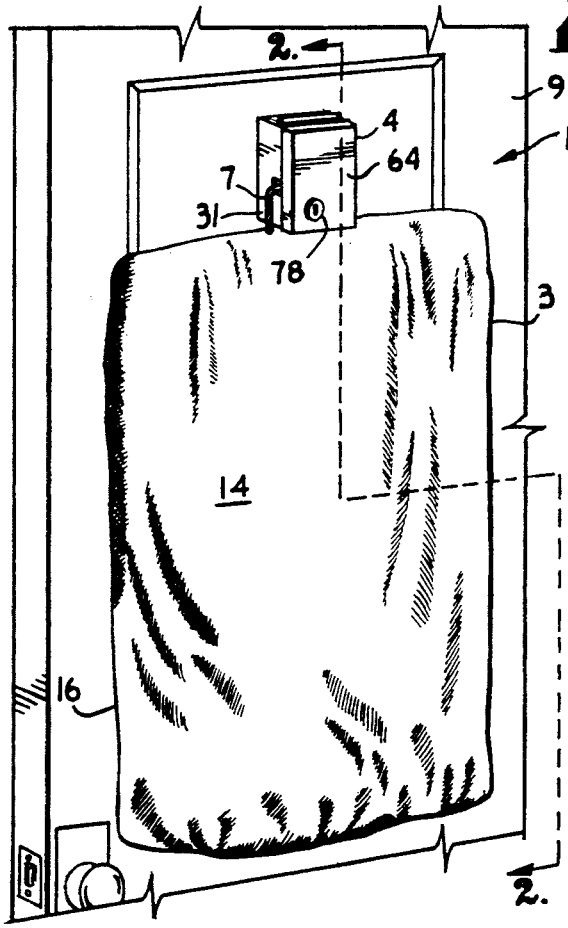
FIG. 1 is a perspective view of a clothing transfer station in accordance with the present invention mounted on a door.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a transfer apparatus or station in accordance with the present invention. The transfer apparatus 1 generally comprises a bag 3 and a capture box 4. The capture box 4 is adapted to receive a handle 7 of the bag and thereafter be secured such that the bag handle cannot be readily removed from the capture box 4 by vandals or thieves.

The apparatus 1 is securely mounted on a structure such as the illustrated door 9 by use of a set of round headed wood screws 10 passing through apertures 11 in the box 4. While the box 4 is illustrated as being mounted on a door, it is foreseen that it could be placed on any surface upon which it could be mounted, such as is associated with an exterior wall of a house or a garage, an interior wall of a garage, a hallway in an apartment building, or the like. Likewise, other securing means, such as welding could be used to secure the box 4 to a supporting structure.

The bag 3 has a front panel 14, a rear panel 15, a pair of side panels 16 and 17, a bottom panel 18 and a top panel 19 all securely interconnected together so as to form a integral and continuous enclosure 21 except for access provided to the enclosure through closure means, such as a zipper 22 in the rear panel 15. The bag 3 is constructed of a strong flexible and generally waterproof material, such as a nylon vinyl laminate or the like which is chosen to substantially resist cutting or tearing. Although it is recognized that materials of this type can be cut, if a person works hard enough at it, the purpose of the bag is to prevent easy access to the clothing and resist unauthorized access as much as possible. It is foreseen that other closures than zippers could be used with the bag 3.

The zipper 22 has an upper head with a ring 24 through which a lanyard 25 is looped. The end of the lanyard 25 opposite the ring 24 includes a ball 26. The ball 26 is inserted in a slot 28 in the box 4 which will be discussed in greater detail below. In this manner the ball 26 can be captured in the slot 28 and prevented from being removed so as to prevent opening of the zipper 22 by unauthorized persons.

The bag handle 7 in the illustrated embodiment is constructed of a single piece of metallic rod bent so as to form a fork like structure with two upright elements 31 and 32 connected by a cross member 33 at the upper end thereof. Positioned along the cross member is an upwardly extending hook 34. While the handle 7 of the present embodiment is illustrated as a single piece, it is also foreseen that the handle could be constructed of at least two pieces with a hook that is movable relative to the remainder of the handle.

The lower end of each of the elements 31 extends through the bag top panel 19 and joins with a cross plate 37. The cross plate 37 has a pair of apertures 38 through which the elements 31 and 32 extend respectively. A pair of nuts 39 on each side of the cross plate 37 hold the bottom ends of the elements 31 and 32 in position relative to the cross plate 37. The cross plate 37 extends generally from side to side of the bag 3 so as to give support to the bag 3, act as a stiffener and to help define the upper end thereof. Depending from the cross plate 37 is a metallic support rod or loop 41 aligned from front to rear of the bag 3 and positioned near the middle of the cross plate 37 with respect to the side panels 16 and 17 of the bag 3. The loop 41 is shaped and sized to receive clothing hangers 42 that can be selectively placed on the loop 41 for support and which, in turn, support clothing, such as the illustrated jacket 43.

Figure 3:
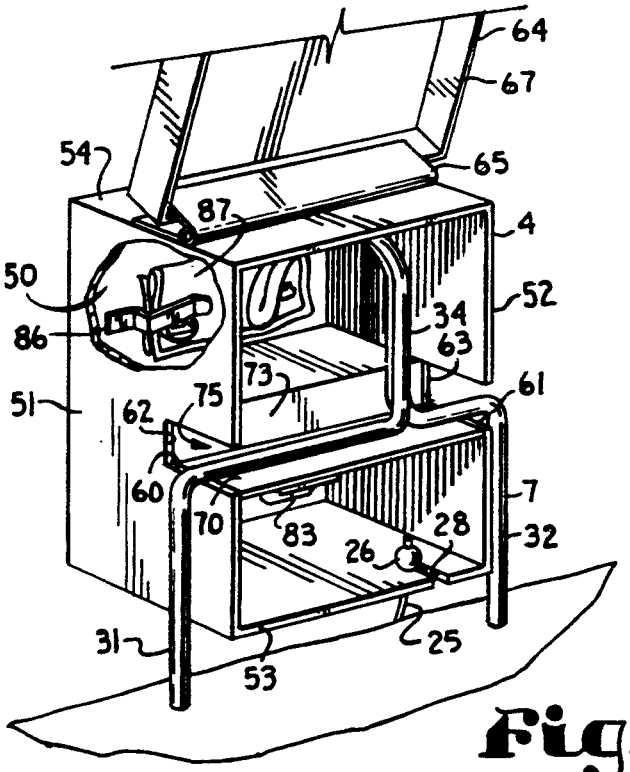
FIG. 3 is an enlarged and fragmentary view of the transfer station with a lid of the apparatus, shown in an open position, with portions broken away to show detail thereof.

As can be best seen in FIG. 3, the box 4 includes a rear panel 50, a pair of side panels 51 and 52, a bottom panel 53 and a top panel 54 which are joined together to provide a more or less open front and rectangular box like structure. Each of the side panels 51 and 52 have a respective slot 60 and 61 that extend from the front edge thereof rearward, approximately halfway up each side panel 51 and 52. The bottom panel 53 includes the slot 28 for receiving the lanyard 25 and capturing the ball 26. The slot 28 extends from the front edge of the bottom panel 53 toward the rear thereof.

A closure lid 64 is mounted on the box 4 by a hinge 65 which connects the top panel 54 to the lid 64. The lid 64 is rectangularly shaped and has a flange 67 which extends around the periphery of the closure 64. The closure 64 and flange 67 are sized and shaped to fit snugly over the front of the box 4.

Figure 2:
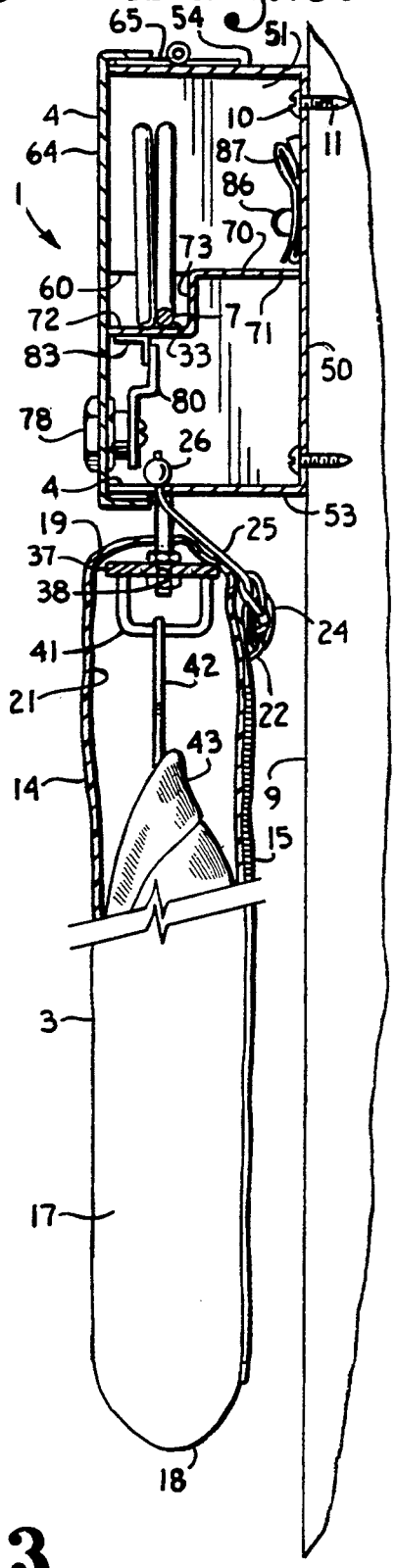
FIG. 2 is an enlarged and fragmentary cross sectional view of the transfer station shown mounted on the door and having clothing therein, taken along line 2—2 of FIG. 1.
Figure 5:
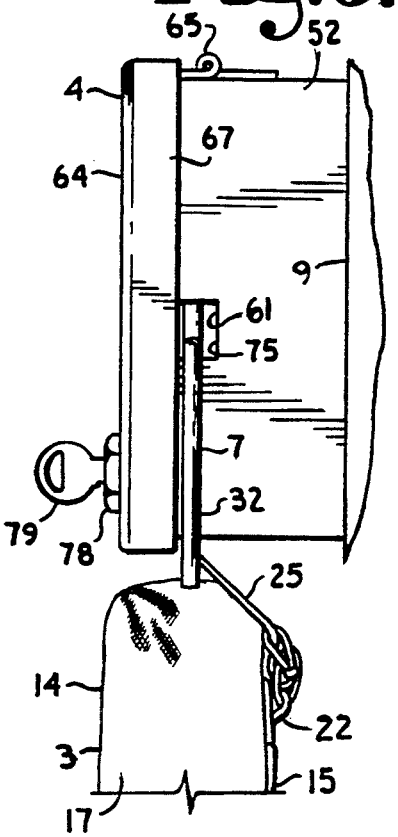
FIG. 5 is an enlarged and fragmentary side elevational view of the transfer station with the closure lid in a closed position thereof.
Figure 6:
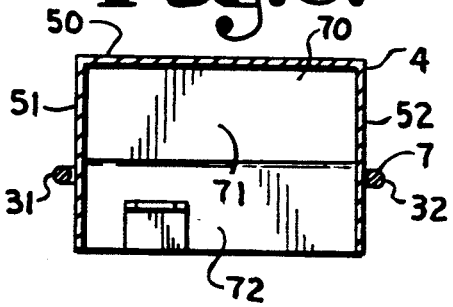
FIG. 6 is an enlarged cross sectional view of the transfer stations, taken along line 6—6 of FIG. 4.

Mounted to extend from side to side within the box 4 is a divider 70. The divider has a rearward section 71, a frontward section 72 and a connecting shelf 73 extending between the rearward and frontward sections 71 and 72. The shelf 73 is positioned to extend continuously between a rearward edge 62 and 63 of each of the slots 60 and 61 respectively. The frontward section 72 is aligned to extend between the lower edges of the slots 60 and 61 so as to form a continuous surface therewith. The slots 60 and 61 in combination with the divider 70 form a receiver 75 for the cross member 33 of the bag handle 7. When the closure 64 is placed in the closed position thereof, such as is seen in FIGS. 2 and 5, the closure lid 64 traps the handle cross member 33 within the receiver 75.

The box 4 is preferably constructed of heavy metal components which are bent or welded together in such a manner so as to resist tampering. It is foreseen that the box 4 could be constructed of certain heavy plasters or the like.

Figure 4:
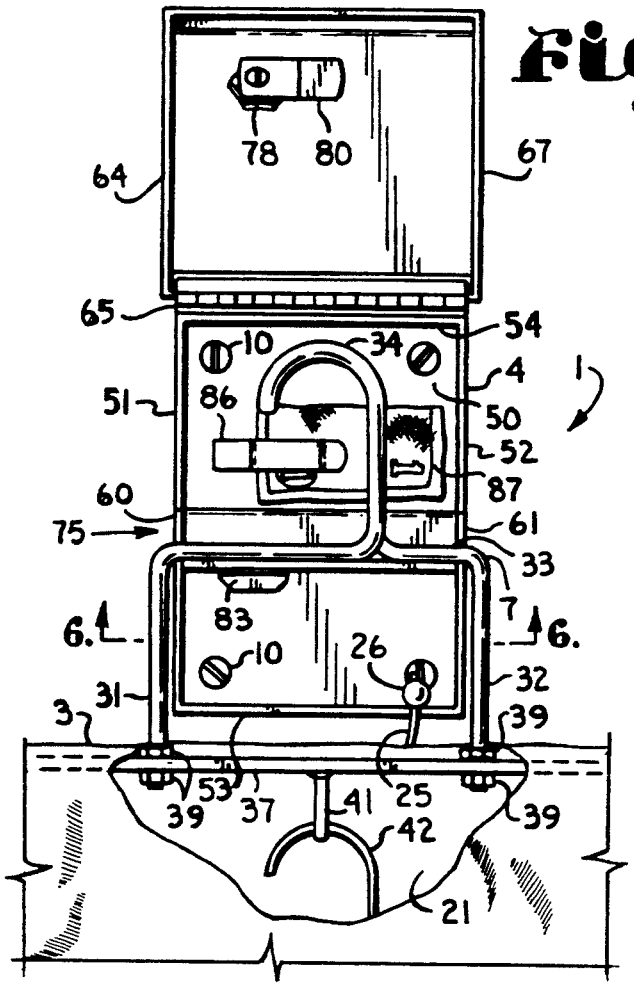
FIG. 4 is an enlarged and fragmentary front elevational view of the transfer station with the closure lid in the open position and with portions broken away to show detail thereof.

Mounted on the closure is a key lock mechanism 78 having a key 79 for activating the mechanism 78 and a locking arm 80 mounted on the divider 70 is a strike plate 83. The strike plate 83 is positioned so as to receive the locking arm 80 thereunder when it is desired to close and secure the lid 64 relative to the remainder of the box 4, as is shown in FIG. 2. The locking arm 80 can also be rotated by operation of the key 79 to a non locking position so as to allow the lid 64 to be opened, as is seen in FIGS. 3 and 4, to allow removal or placement of the handle cross member 33 within the receiver 75.

A clip 86 is secured to the inside surface of the box rear wall 50 for receiving money 87, checks or the like.

In use, the owner of the cleaning places dirty cleaning inside the bag 3 and the zipper 22 is closed. The bag handle 7 is placed in the capture box 4, as is shown in FIG. 4. The lanyard is placed through the slot 28, so that the ball 26 is captured by the box 4. Monetary payment may be placed in the clip 86, if needed. The lid 64 is then closed and the lock mechanism 78 is locked.

A representative of the cleaners later reverses the process and removes the bag 3 with the dirty clothes from the box 4. Another bag 3 with clean clothes, such as suit 43, is then captured by the box 4 for the owner to remove later. It is noted that the handle hanger 34 allows the owner to hang the bag 3 in a closet and also allows the delivery person to hang the bag 3 on racks in a delivery truck or at a cleaning facility.

While a specific bag has been disclosed for use with the present invention, the bag could be constructed of various materials, including rigid materials for certain purposes. Likewise, the bag could be used to transfer other products such as diapers that may require a different configuration as compared to that shown. It is also foreseen that the lock mechanism could be an electronic locking device actuated by a digital key board. Also, it is foreseen that anchors or the like may have to be utilized in conjunction with the mounting mechanism to ensure a strong stable mounting.

It is to be understood that while certain forms of the present invention have been illustrated and described herein, it is not to be limited to the specific forms or arrangement of parts described and shown.

What is claimed and desired to be secured by Letters Patent is as follows:

1. A secure transfer station for transferring goods between two parties where one of the parties is not present; the station comprising:

(a) a bag adapted to receive and completely enclose goods to be transferred; said bag having a handle and a bag closure;

(b) means for securing said bag closure against opening by unauthorized persons;

(c) said bag handle projecting from the bag; said handle including a crossmember having opposite ends secured to said bag such that said handle forms a substantially continuous structure;

(d) a capture box including mounting means for securely mounting said box on a surface; said box having a receiver for receiving said handle crossmember; said box including capture box closure means for selectively closing said box having a first position allowing said handle crossmember to be placed into and removed from said receiver and a second position preventing said handle crossmember from being removed from said receiver said handle being configured such that said bag except for said handle is located outside of said capture box when said handle crossmember is placed in said receiver; and locking means for selectively locking said capture box closure means in said second position thereof.

2. A secure transfer station for transferring goods between two parties where one of the parties is not present; the station comprising:

(a) a bag adapted to receive and completely enclose goods to be transferred; said bag having a handle and a bag closure;

(b) means for securing said bag closure against opening by unauthorized persons;

(c) said bag handle projecting from the bag;

(d) a capture box including mounting means for securely mounting said box on a surface; said box having a receiver for receiving said handle and capture box closure means having a first position allowing said handle to be placed into and removed from said receiver and a second position preventing said handle from being removed from said receiver, and locking means for selectively locking said capture box closure means in said second position thereof; and (e) said handle includes two upright connecting sections each joined at one end to said bag and at an opposite end to a cross member; said receiver being sized and shaped to receive only said cross member such that said connecting sections and said bag remain entirely outside said capture box during usage.

3. The station according to claim 2 wherein:

(a) said cross member includes a hook adapted to allow the hanging of said bag on a rod.

4. The station according to claim 2 wherein:

(a) said receiver includes structural means forming a slot with open ends for receiving said cross member and allowing opposite ends of said crossmember to extend outwardly from said box when the crossmember is placed in the receiver; said structural means also forming an open front when said capture box closure means is in the first position thereof and said receiver front being covered to prevent removal of the crossmember from the receiver when said capture box closure means is in the second position thereof.

5. The station according to claim 2 including:

(a) means for receiving money within said box such that said money is not accessible when said capture box closure means is in the second position thereof.

6. The station according to claim 2 wherein:

(a) said bag includes a crossplate within said bag when said bag closure means is closed;

(b) said crossplate being secured to said bag handle; and (c) said crossplate including hanger means to support clothing.

7. The station according to claim 2 wherein:

(a) said capture box closure means includes a hinged lid;

(b) said box has an open front when said lid is in the first position thereof;

(c) said receiver comprises a receiving slot that is accessible for receipt of or removal of said crossmember when said lid is in the second position thereof; said lid preventing removal of said crossmember from said receiving slot when in the second position thereof; and (b) said locking means comprising a key operated lock mechanism.

8. A secure transfer station for transferring goods between two parties where one of the parties is not present; the station comprising:

(a) a bag adapted to receive and completely enclose goods to be transferred; said bag having a handle and a bag closure;

(b) means for securing said bag closure against opening by unauthorized persons;

(c) said bag handle projecting from the bag;

(d) a capture box including mounting means for securely mounting said box on a surface; said box having a receiver for receiving said handle and capture box closure means having a first position allowing said handle to be placed into and removed from said receiver and a second position preventing said handle from being removed from said receiver, and locking means for selectively locking said capture box closure means in said second position thereof;

(e) said bag closure means comprises a zipper; and (f) said means for securing said bag against opening comprises a lanyard secured at one end thereof to said zipper and having a wide end opposite said zipper; said box having a slot to capture said lanyard wide end within said box when said capture box closure means is in the second position thereof.

9. An apparatus for transferring clothing between an owner of the clothing and a cleaner; said apparatus comprising:

(a) a bag adapted to receive the clothing to be transferred; said bag constructed of a material to resist tearing and forming an enclosure to receive the clothing; said enclosure being accessible by an opening closed by a zipper; a lanyard attached at one end to the zipper and having an enlarged opposite end; and an interior upper crossplate within said bag with hanger means thereon to receive hangers;

(b) said bag having attached thereto a handle; said handle having a pair of upright side sections each being attached at first ends thereof to said crossplate so as not to be removable from said bag when said bag opening is closed; said handle side sections being attached at second ends thereof to a crossmember; said crossmember being substantially smaller in size than the width of said bag; said cross member including a hanger to allow hanging of said bag thereby; and (c) a capture box; said box being generally rectangular in shape and sized to be substantially smaller than said bag so as to have a relatively low profile when not in use capturing said bag; said box including mounting means for mounting said box on a surface, a hinged closure lid having an open position and a closed position, and locking means for selectively securing said lid in the closed position; said box also including structural means forming a receiver for said crossmember, such that when said lid is placed in the closed position with said crossmember in said receiver, said crossmember extends from opposite sides of the box and said handle is captured such that said crossmember cannot be removed from said receiver and said bag is entirely outside of said box; said box having a lanyard slot for receiving said lanyard enlarged opposite end for capture of the lanyard upon movement of the lid to the closed position thereof and so as to thereby prevent unauthorized entry through said bag opening.

* * * * *